US006807779B1

(12) United States Patent
Höcker et al.

(10) Patent No.: US 6,807,779 B1
(45) Date of Patent: Oct. 26, 2004

(54) FACADE AND/OR ROOF AND SEALING STRIP

(75) Inventors: Eitel-Friedrich Höcker, Bielefeld (DE); Dieter Steege, Bad Salzuflen (DE)

(73) Assignee: Schüco International KG, Bielefeld (DE)

( * ) Notice: Subject to any disclaimer, the term of this patent is extended or adjusted under 35 U.S.C. 154(b) by 0 days.

(21) Appl. No.: 10/433,226

(22) PCT Filed: Dec. 14, 2001

(86) PCT No.: PCT/EP01/14799

§ 371 (c)(1),
(2), (4) Date: May 29, 2003

(87) PCT Pub. No.: WO02/053856

PCT Pub. Date: Jul. 11, 2002

(30) Foreign Application Priority Data

Dec. 29, 2000 (DE) ..... 100 65 272

(51) Int. Cl.[7] ..... E06B 7/14

(52) U.S. Cl. ..... 52/209; 52/204.57; 52/204.53; 52/204.71

(58) Field of Search ..... 52/209, 204.57, 52/200, 204.53, 204.6, 204.69, 204.71; 428/34

(56) References Cited

U.S. PATENT DOCUMENTS 4,449,340 A * 5/1984 Jentoft et al. ..... 52/200
5,356,675 A 10/1994 Unger et al.

FOREIGN PATENT DOCUMENTS

| | | |
|---|---|---|
| DE | 34 19 538 C2 | 11/1985 |
| EP | 1 029 999 A1 | 8/2000 |
| GB | 2 137 673 | 10/1984 |
| GB | 2 152 122 A | 7/1985 |

* cited by examiner

*Primary Examiner*—Carl D. Friedman
*Assistant Examiner*—Naoko Slack
(74) *Attorney, Agent, or Firm*—Henry M. Feiereisen

(57) ABSTRACT

The invention relates to a facade and/or a roof comprising a metal framework. Preferably, the case bays of said metal framework can be provided with insulating glass panes. The vertical member profiles and the cross member profiles comprise sealing grooves (5, 6, 9) for sealing strips (10, 13, 13.1) on which said insulating glass panes (102) can be supported. The bottoms of said sealing grooves (5) for the sealing strips (10) and, preferably, the bottoms of the receiving grooves (8) for the leakage water of the cross member profiles (2) rest on the sealing grooves (6, 9) of the sealing strips (13, 13.1) of the vertical member profiles (1). The single-part or multi-part sealing strips (13, 13.1) of the vertical profiles are higher than the searing strips (10) of the cross member profiles in such a way that the sealing strips (10, 13, 13.1) of the cross member profiles and the vertical member profiles occlude in a common plane. Said facade and/or roof is characterised in that at least one of the sealing strips (10, 13, 13.1) of the cross member profiles (1) and/or the vertical member profiles (2) comprises at least one drainage channel, preferably a condensate channel (11, 18).

38 Claims, 12 Drawing Sheets

FACADE AND/OR ROOF AND SEALING STRIP

BACKGROUND OF THE INVENTION

The invention relates to a facade and/or roof and a sealing strip.

In spite of improved thermal insulation of glass panes and panels for facades constructed from cross members and vertical members and well as for roof window structures and verandas, the collection and diversion of condensate in the marginal regions of the panes is still of particular importance.

In particular, when the sloped roof areas or facades are inclined towards the horizontal, the condensate must be collected and drained in the lower region of the inclined area. The horizontal and sloped cross member profiles are primarily affected by the draining and/or dripping condensate.

The German patent DE 34 19 538 describes a facade and a roof embodied in a metal-glass structure, wherein the vertical and cross member profiles each have condensate water channels arranged on both sides of the marginal edges.

The planes of the condensate water channels are arranged such that, when the cross member profile is connected to the vertical member profile, the channel bottom of the condensate channel of the cross member profile is supported on the boundary wall of the condensate channel of the vertical member, whereby the condensate is transferred from the cross member profile to the vertical member profile and then discharged at a suitable location by the condensate channel of the vertical member. As a result of the overlap, the condensate channel of the vertical member profile extends unrestricted to the bottom area or to a drainage region of a roof.

This construction has proven to be non-optimal, because the cross member and vertical member profiles have to be designed with a greater width than technically required for the glass support, since the corresponding condensate channels also have to form a partially open channel beyond the glass support region, as viewed in the vertical direction.

This represents a increased material consumption for the profile and a more visible surface, which then increases the coating costs. In addition, wider profiles are inconsistent with the architectural quest for smaller profiles.

Moreover, the cross member profile has to be notched in order to overlap the condensate water channel of the cross member on the vertical member, which places a particular burden on the processor and significantly adds to the cost.

SUMMARY OF THE INVENTION

It is therefore an object of the invention to provide a structurally simple and reliable condensate collection and discharge system, so that the overall widths of the metallic vertical member profile and of the metallic cross member profile are identical.

The invention solves this object by a facade and/or roof with a metal framework having frame areas which can preferably be provided with insulating class panes, wherein the framework has vertical member profiles and cross member profiles which are oriented perpendicular to the vertical member profiles, the vertical member profiles and cross member profiles include sealing grooves for sealing strips on which the insulating glass panes can be supported, the vertical member profiles and cross member profiles further include receiving channels for leakage water, the bottoms of the sealing grooves for the sealing strips and preferably the bottoms of the receiving channels for the leakage water of the cross member profiles are positioned on the sealing grooves of the sealing strips of the vertical member profiles, and the one-part or multi-part sealing strips of the vertical member profiles have a greater overall height than the sealing strips of the cross member profiles, so that the sealing strips of the cross member and vertical member profiles terminate in a common plane, wherein at least one or more sealing strips of the cross member profiles and/or of the vertical member profiles has/have at least one drainage channel, preferably a condensate channel.

Unlike the state-of-the-art, at least one of the sealing strips of the cross member profiles and/or the vertical member profiles includes at least one drainage channel, preferably a condensate channel.

Preferably, the condensate channel is formed as one piece of the sealing strip in a cost-effective manner without adversely affecting the installation. This embodiment of the invention thus obviates the need for, installing an additional element, although the invention can be modified by adding useful elements recited in the dependent claims.

It has proven to be particularly advantageous, if the condensate channel of the cross member profile extends directly or indirectly to the glass support area of the vertical member profile and is designed to drain into channels of the vertical member profile. This arrangement advantageously retains the conventional drainage techniques, while at the same time reducing the number of components.

According to a separate modified embodiment, the invention solves the object also by a sealing strip for cross member and vertical member profiles, in particular glass support sealing strip for a facade and/or a roof, wherein at least one or several sealing strips of the cross member profile and/or the vertical member profile have a drainage channel which is formed as one piece on the glass support area of the seal, in particular for condensate, and preferably has a substantially rectangular U-shaped cross-section.

Since the condensate channels are now unexpectedly no longer associated with a metal profiles, but in a simple and cost-effective manner with the sealing strips, it is possible to flexibly adapt to different installation situations, in particular where the facade transitions into inclined and horizontal regions—i.e., transitions info roof window regions or where excessive generation of condensate is expected. The shape of the sealing strip according to the invention makes it possible to reliably discharge large quantities of condensate.

The condensate channel of the sealing strip is constructed at right angles, which is visually pleasing and functional, and preferably dimensioned according to the subject matter of the additional dependent claims, so that it has a particular advantageous relationship to the other sealing strips of the vertical member profiles.

With the sealing strip of the invention, the same profile combination can be used in the vertical section of the facade and in the horizontal roof window section.

The seal which consists of elastic material can be easily processed using a knife and scissors and ensure a high degree of leak tightness, without placing an excessive burden on the installer.

The condensate channel on the sealing strip of the cross member compensates optically the height differences of the seals relative to the vertical member.

The finished length of the seals need not be overly exact, since a small excess length of the seals is elastically compensated by compression over the entire length. The joints between seals and between the corner and/or end pieces are elastically sealed even more robustly by a slight excess length of the seals of preferably 1–2%.

In particular, only one sealing strip may be required for a cross member with a condensate channel of horizontal cross member profiles with straight sloped surfaces. This seal has to be installed on the surface of the cross member profile towards the upwardly sloped area and is typically sufficient for collecting and diverting the condensate. Glass panes with a low R-value and fill plates and/or roof constructions with a relatively small slope may require that the frame areas along the circumference or at least on three sides are provided with condensate collecting channels.

The sealing strip with the condensate channel can be applied wherever condensate generation is expected, in particular on the underside of inclined glass planes and fill plates, where the condensate drains towards the cross member profile.

Additional components, which form the subject matter of additional dependent claims, can be used to provide a tight sealing plane and glass support in a simple manner.

Additional embodiments of the invention are recited in the dependent claims.

BRIEF DESCRIPTION OF THE DRAWINGS

Embodiments will be described hereinafter with reference to the drawings. It is shown in.

DETAILED DESCRIPTION OF PREFERRED EMBODIMENTS

Figure 1:
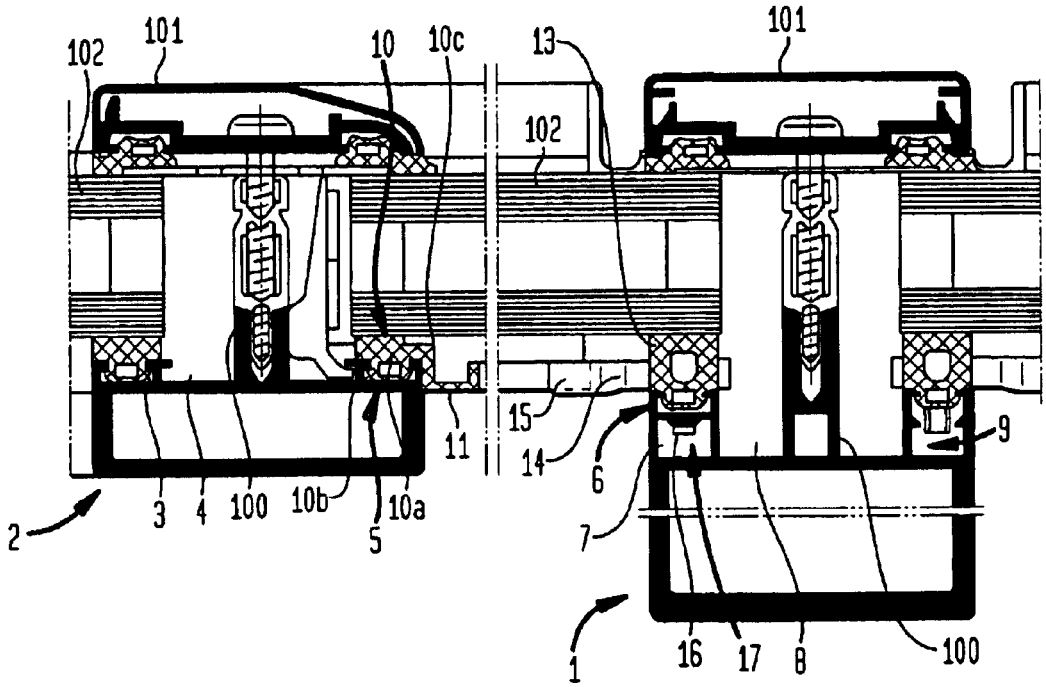
FIG. 1 on the left-hand side, the cross-section of the cross member profile region and, on the right-hand side, the cross-section of the vertical member profile region of a first embodiment of a facade according to the invention, wherein the left-hand side and right-hand side of the vertical member profile represent different exemplary embodiments.

FIG. 1 shows a part of a facade embodied in a metal glass structure with a metal framework of vertical member profiles 1 and cross member profiles 2 which are oriented at an angle and are installed on the vertical member profile 1.

The end faces of the vertical member profile 1 and the cross member profile 2 each have a center rib 100 which is configured for securing cover plates 101. These cover plates 101 hold inserts, such as plates, for example insulating glass panes 102.

The end faces of the cross member profile 2 are notched in such a way that the profile wall 3 which faces the insulating glass pane and forms the bottom for the leakage water channel 4 and the sealing groove 5, is supported on the installed state of the sealing groove 6 of the vertical member profile 1.

The sealing groove 6 of the vertical member profile 1 is located—when viewed from the building side of the facade—above a cavity 7. The sealing groove 6 and the cavity 7 together delimit the leakage water channel 8 of the vertical member profile 1.

In the exemplary embodiment shown on the right-hand side of the vertical member profile 1 in FIG. 1, the sealing groove 6 of the vertical member profile 1 can also be formed so as to be open towards the bottom, so that the sealing groove 6 extends into the region of the cavity 7 and the sealing groove 6 is combined with the cavity 7 to a sealing groove 9 which combines a function of the sealing groove and the cavity.

The sealing strip 10 with the actual glass support region 10*a* and the sealing foot 10*b* of the cross member profile 2 advantageously includes a condensate channel 11 which is formed on the glass support region 10*a* as one-piece and has preferably a rectangular shape.

The channel wall of the condensate channel 11 facing the sealing element of the sealing strip 10 sealingly contacts the outer surface of the cross member profile 2. The underside of the channel bottom 2 is aligned or flush with the underside of the profile wall 3. In principle, the condensate channel 11 can have other shapes, for example a round cross-section, although a rectangular shape is preferred because of the advantageous visual effects and stability. It is important that the channel cross-section is dimensioned so as to support a sufficiently large water discharge and provide adequate rigidity. Particularly advantageous is also the one-piece construction of the sealing strip 10. Various multi-piece constructions of the sealing strip are also feasible.

The sealing strip 10 extends into the region of sealing strip 13 of the vertical member 1 where it contacts an end sealing element 14 to which the glass support seal 13 of the vertical member 1 is connected or formed.

The end sealing element 14 has an extension 15 to the sealing strip 10 of the cross member profile 2, which corresponds to the condensate channel 11 and encompasses the condensate channel 11 on the side and from below, thereby supporting and aligning the condensate channel 11.

The end sealing element 14 includes a condensate channel which faces the cross member profile and terminates in the alignment region of the sealing strip 13 in a closed hollow channel, from which a drain 16 extends downwardly, penetrating the channel bottom 17 of the sealing groove 6 and terminating in the cavity 7. Alternatively, the drain 16 extends into the sealing groove 9 which is open towards the bottom. In this case, the drain 16 in the end sealing element 14 may be omitted, so that only a drain opening is provided in the sealing element of the end sealing element 14.

The facade structure depicted in FIG. 1 with the novel seal provides a cost-effective condensate drainage system of simple construction which operates reliably and separately from the leakage water drainage of the leakage water channels 4 and 8.

Figure 2:
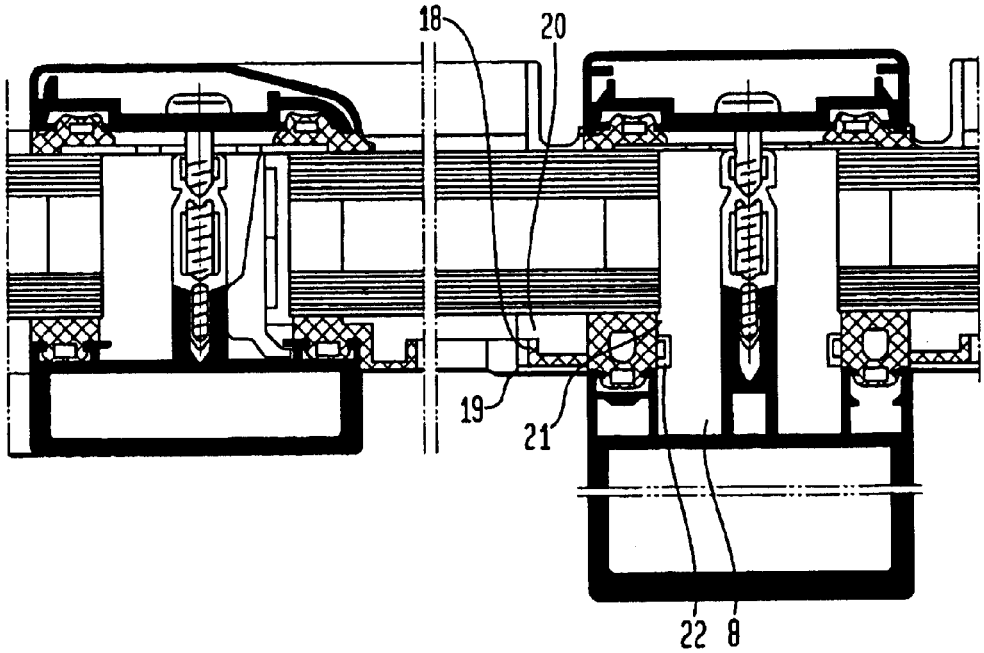
FIG. 2 on the left-hand side, a cross-section of the cross member profile region and, on the right-hand side, a cross-section of the vertical member profile region of the first embodiment of a facade according to the invention, wherein the left-hand side and right-hand side of the vertical member profile again represent different exemplary embodiments.

FIG. 2 shows a facade structure, wherein the vertical member and cross member profile 1, 2 are identical to that of FIG. 1. In addition to FIG. 1, however, the sealing strip 21 of the vertical member profile 1 also includes a condensate channel 18 which is formed directly on the glass support region of the sealing strip, which is once more encompassed and supported by an extension 19 of an end sealing element 20.

The end sealing element 20 includes a kind of foot, which engages with and is formfittingly secured in both the sealing groove 5 of the cross member profile and the sealing groove 6, 9 of the vertical member.

The end sealing element 20 furthermore includes a channel which is flush with the condensate channel 11 and lengthens the condensate channel and extends through the leg of the end sealing element which is flush with the sealing strip 21.

In this way, the leakage water channel 8 of the vertical member is directly connected with the condensate drainage system, i.e., the condensate is discharged directly into the leakage water drainage system.

The end sealing element 20 can include a drain extension 22 towards the leakage water channel 8.

According to FIG. 2, the drainage system for the condensate and the leakage water are no longer separate, but combined into an all-inclusive system.

This makes it also possible to reduce the air exchange between the leakage water channel 8 and the condensate channel 11, 18 to a minimum. For this purpose, a fibrous filter insert 25 (see above) is inserted in the channel that connects the condensate channels with the leakage water channel 8 of the vertical member. The filter insert 25 impedes air exchange, but also diverts the accumulating condensate to the leakage water drain through adhesion and through the capillary action of the filter material.

The two different drainage systems of FIGS. 1 and 2, meaning the combined or separate drains, as well as the arrangement of a condensate channel 18 on the sealing strip 21 can be interchangeably employed in various ways.

The sealing strip 10 with the condensate channel 11 for the cross member profile 2 should be arranged on sloped surfaces at least on the topside of the cross member profile. This seal can also be placed on both sides of the cross member profile if the roof surfaces or the facades have a smaller slope. The same applies to facades where condensate accumulated on the topside of cross member profiles can be collected and drained through the condensate channel.

The construction and function of the facade drainage system will now be described in more detail with reference to the additional drawings.

Figure 3:
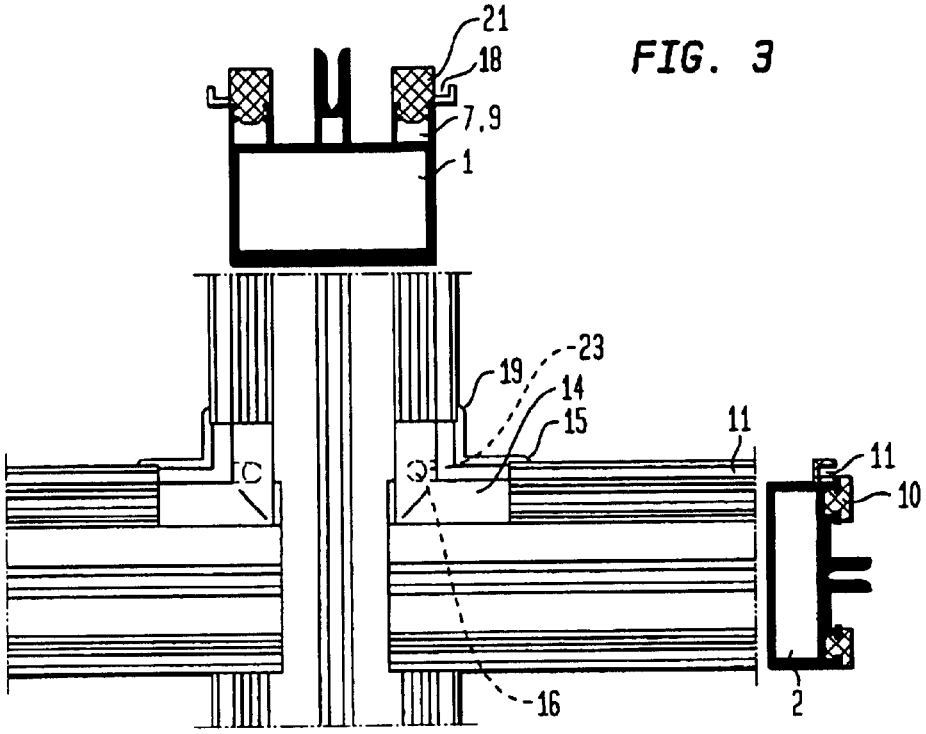
FIGS. 3, 4 a modification of a separate drainage of the leakage water into the space or the cavity under the sealing strip.

FIG. 3 shows a top view of a profile crossing point between, vertical member 1 and cross member 2. The sealing strip 21 with the integrated condensate channel 18 is disposed on the vertical member 1. The sealing strips 10, 21 are connected via the end sealing element 20. The condensate channels 11, 18 are surrounded and supported by the extensions 15, 19, which also provide a sealing function. In addition, correspondingly larger adhesive surfaces suitable for connecting the seals with the end sealing element are obtained.

FIG. 3 shows the separate drainage of leakage water into the space 9 and the cavity 7 under the sealing strip 21. Also visible is the drainage channel 23 which extends beyond the condensate channel 11 to the end sealing element 20 and to the drain 16.

Figure 4:
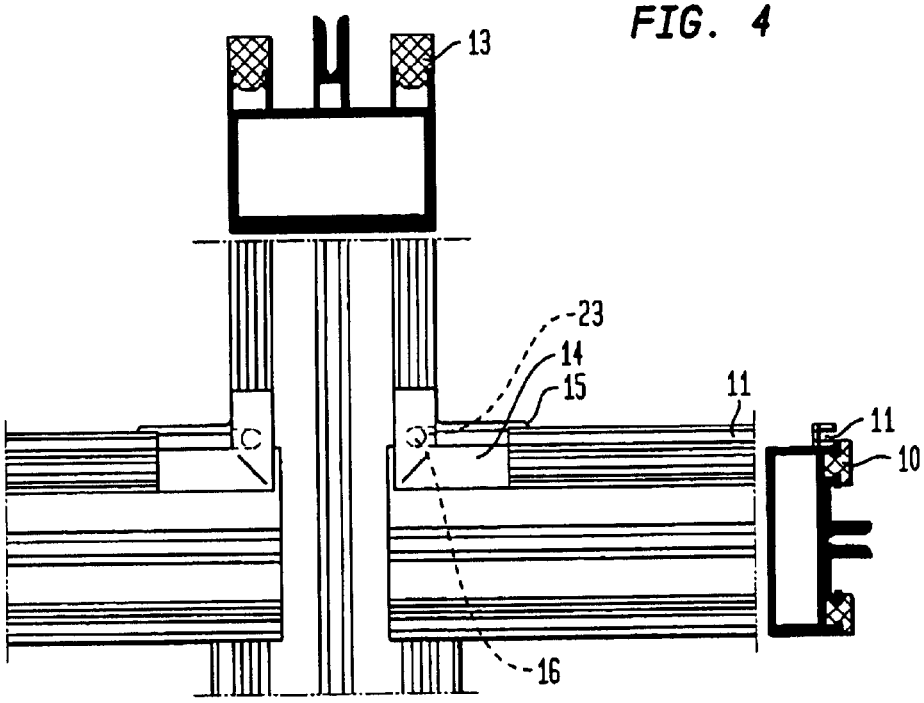

FIG. 4 shows, unlike FIG. 3, also is sealing strip, or in this case a glass support seal 13, for the vertical member 1, however here without a condensate channel.

Figure 5:
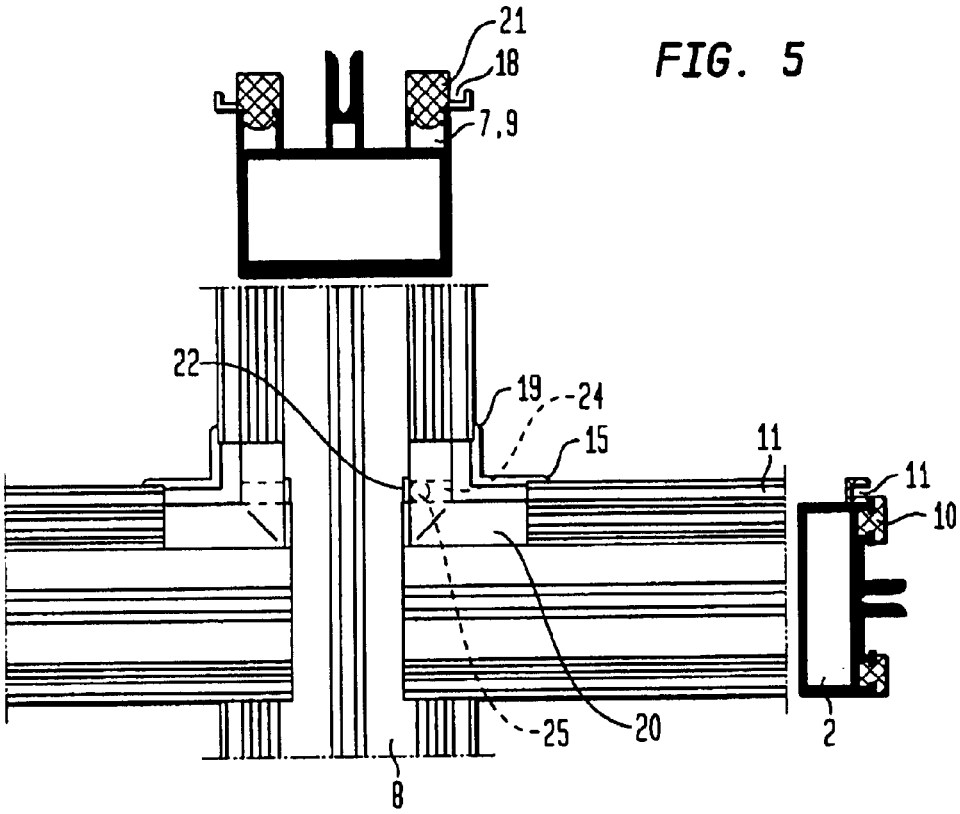
FIG. 5 a crossing point of a facade of the type depicted in FIG. 1.

FIG. 5 shows a top view of a facade of the type depicted in FIG. 2. The drainage channel 24, which is aligned with the condensate channel 11 and terminates in the leakage water channel 8 of the vertical member 1, is clearly visible in this top view of a profile crossing point This drainage channel is filled with a filter insert 25 which essentially prevents air exchange between the leakage water channels 8, also referred to as joint spaces, and the condensate channels, also referred to as interior spaces. Only the condensate is diverted through adhesion on the fibers and capillary action in the channels formed by the fibers.

Figure 6:
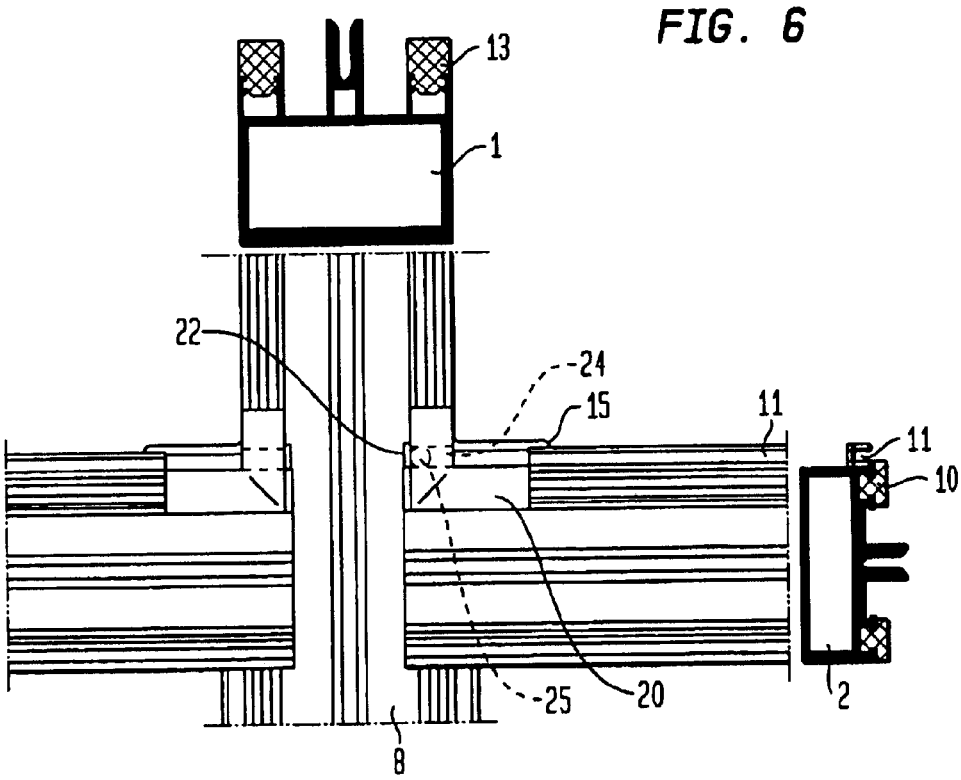
FIG. 6 a crossing point of a facade of the type depicted in FIG. 1, wherein the sealing strip of the vertical member does not have a condensate channel.

FIG. 6 corresponds essentially to the structure of FIG. 1, except that the sealing strip 13 is implemented without a condensate channel and drainage is achieved—as in FIG. 5—via the drainage channel 24 and the installed filter insert 25.

Figure 7:
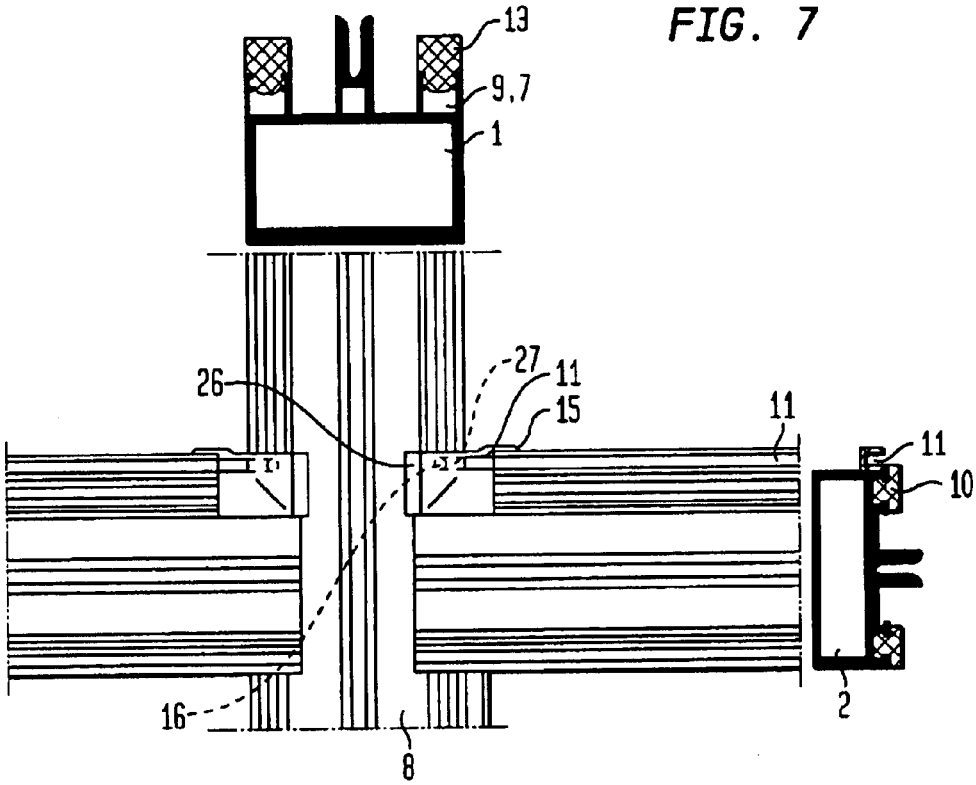
FIGS. 7–10 a top view of modifications of the crossing regions of vertical member profile and cross member profile.

According to FIG. 7, only the sealing strip 13 has to be inserted into the vertical member 1. The sealing strip 10 with the condensate channel 11 contacts an end sealing element 26 which extends the cross member seal 10 into the region of the vertical member profile 1. The end sealing element 26 engages with a foot section in the sealing groove 5 of the cross member profile wherein it is affixed together with the seal 10. The width of the end sealing element 26 corresponds to the total width of the sealing strip 10, including the condensate channel 11, so that the end face of the seal 13 can be sealingly urged against the outside of the end sealing element 26. In extension of the condensate channel 11, the end sealing element 26 includes a drainage channel 27, before which a condensate channel 11 can be connected. The drainage channel 27 terminates in a drain 16 which directs the condensate into the space 9 or the cavity 7 of the vertical member, separate from the leakage water.

Figure 8:
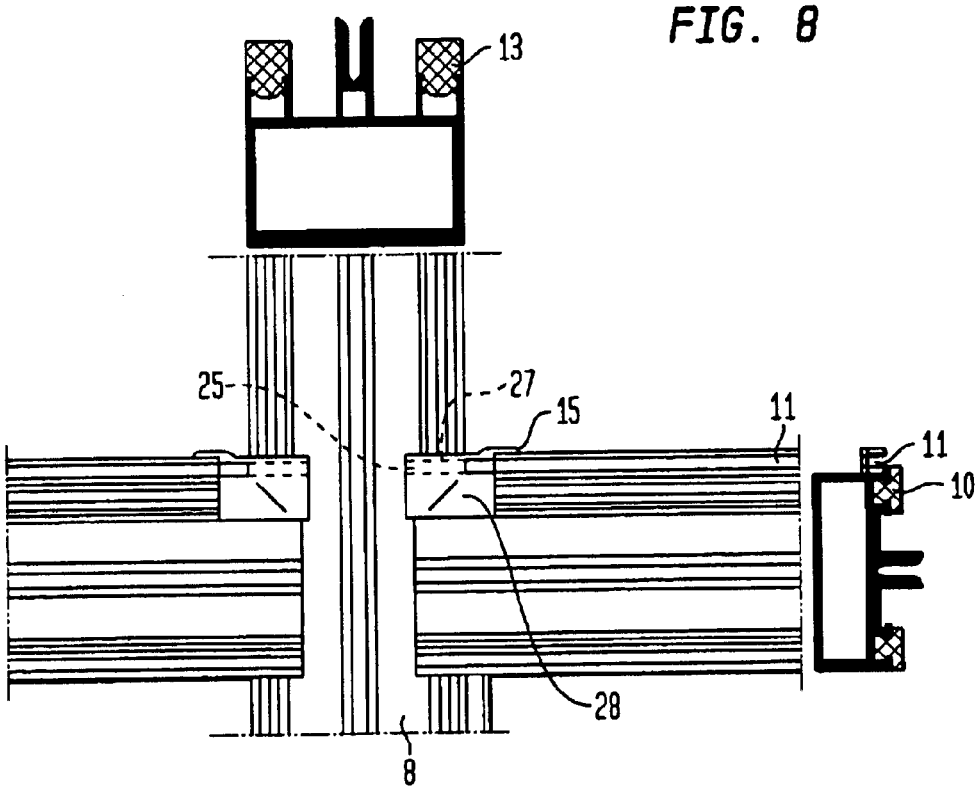

FIG. 8 shows, like FIG. 7, the crossing point of a vertical member profile 1 with the cross member profile 2. Shown is an end sealing element 28 which is provided in the overlap region between the cross member profile and the vertical member and which has a drainage channel 27 that terminates in the drainage channel 8 or in the joint of the vertical member profile. This end sealing element 26 is particularly suited for cross member profiles that are joined at an angle, since the end sealing element 26 can be cut to the joining angle of the profiles.

The surface of the end sealing element 26 facing the sealing strip 13 is smooth and can be sealingly attached to the glass support seal 13. The drainage channel 27 is provided with the filter insert 25, as previously shown in FIGS. 5 and 6.

Figure 9:
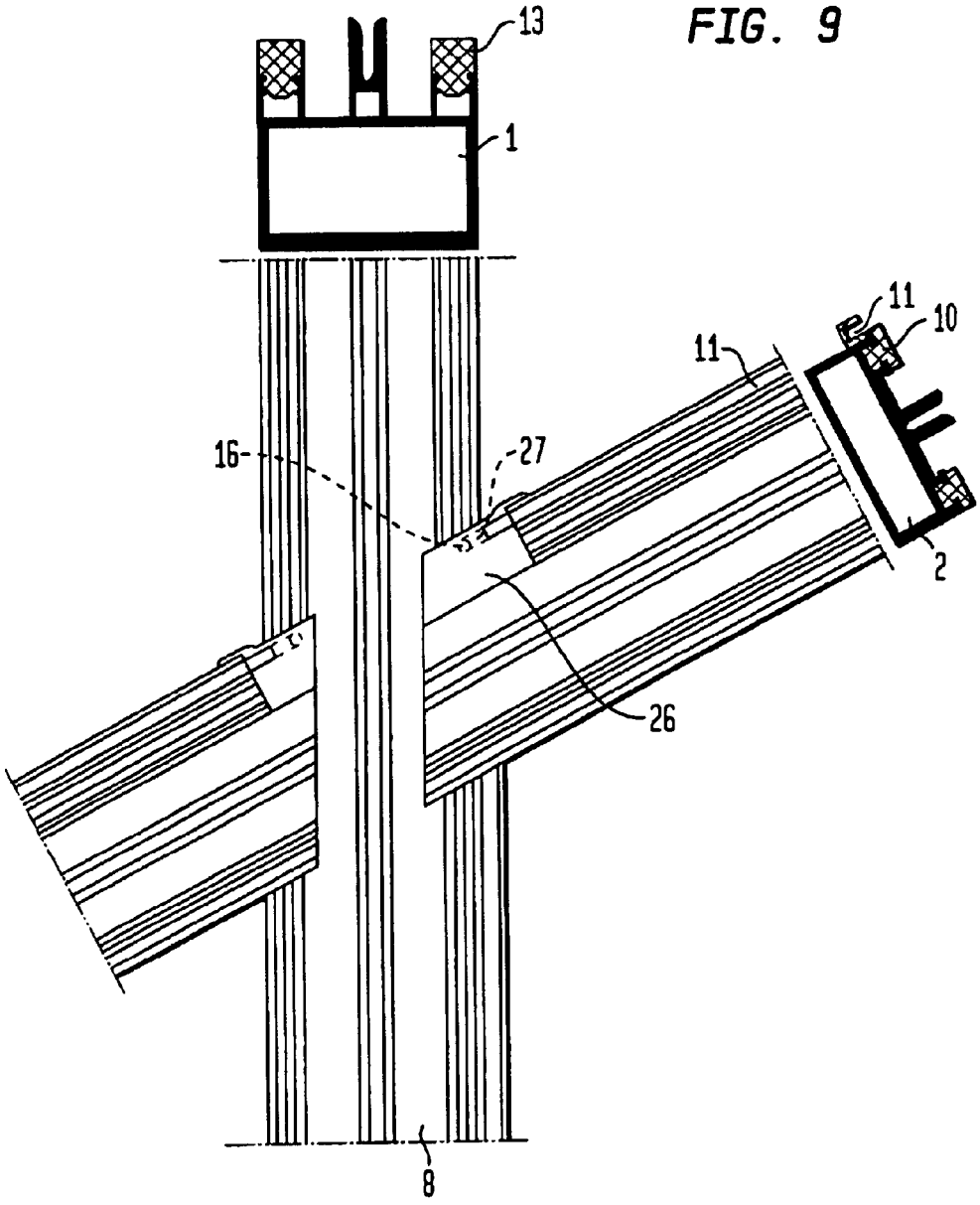
Figure 10:
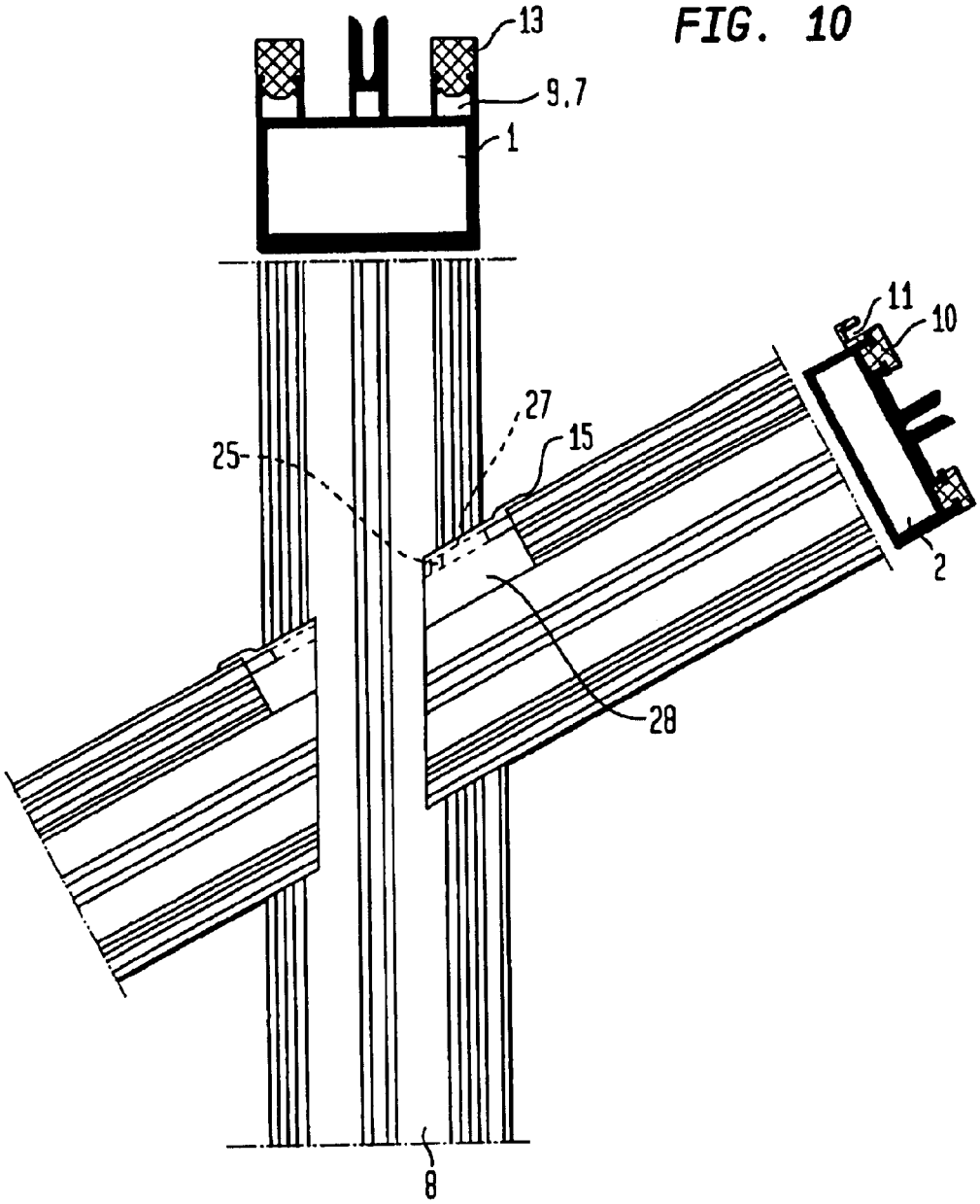

FIGS. 9 and 10 further show that the end sealing element 26 is mainly intended for the crossing points where the cross member profile 2 abuts the vertical member profile at an angle. For this purpose, the end sealing element is configured to be correspondingly longer than for a square joint, so that it can be easily adapted to different configurations.

FIG. 9 shows the aforementioned angled joint between the cross member profile and the vertical member profile and therefore corresponds to the aforedescribed FIG. 7. Only the end sealing element 26 and the sealing strip 13 are matched to the joining angle of the profiles.

FIG. 10 is a top view of an angled joint between a cross member and a vertical member, while corresponding in all other aspects to the description of FIG. 8. Only the end sealing element 28 and the sealing strip 13 of the vertical member are configured to match the crossing angles.

Figure 11:
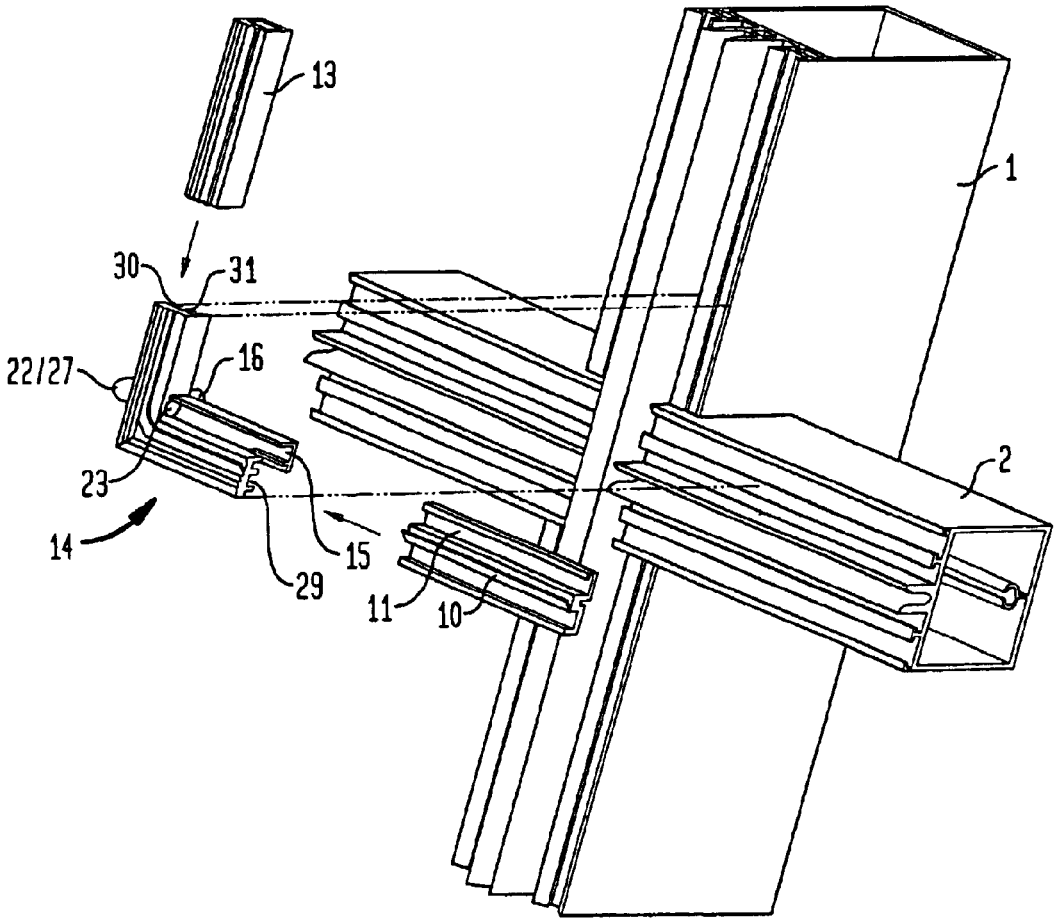
FIGS. 11, 12 perspective exploded views of profile crossing regions.

FIG. 11 is a perspective exploded view of the structure of a connection between a cross member and a vertical member of a facade. The cross member profile 2 overlaps the vertical member profile 1 in the region of the sealing groove. The difference in height is compensated by the different heights of the seal 10 and the seal 13, 13.1. This difference in height is also compensated by the end sealing element 14. Shown is an end sealing element 14 and a sealing strip which does not include the condensate channel 18 depicted in FIG. 2. The end sealing element 14 is clearly visible. The legs of the end sealing element included in the joining region with the respective sealing strip 10, 13 centering cams 29, 30, 31 which cooperate and engage with corresponding cavities in the glass support profiles, thereby fixing the position of the components relative to each other. The cams simultaneously increase the size of the contact surfaces, enabling the components to be joined later with an adhesive.

The drain 16 or the drainage extension 22 with the drainage channel 27 that is closed by a filter insert 25 can be arranged either on the end sealing element 14 or on the end sealing element 20.

Figure 12:
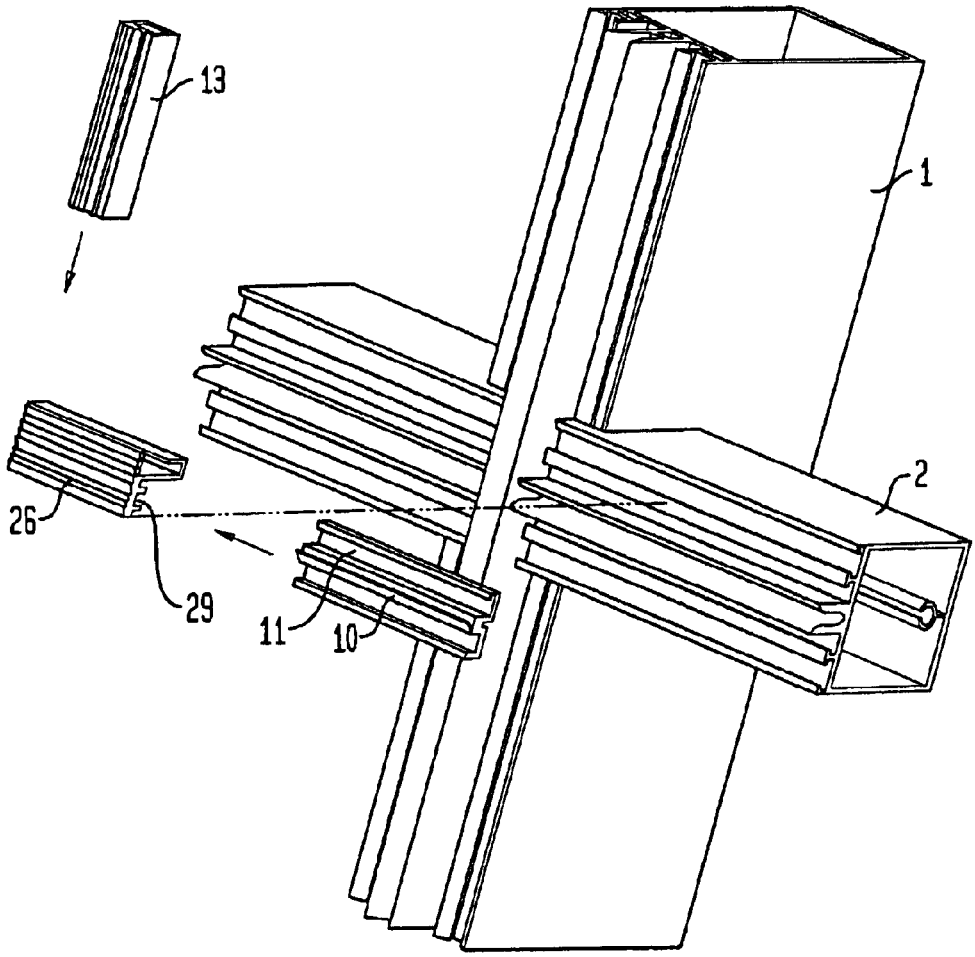

FIG. 12 also shows a perspective exploded view of a crossing point of a facade with cross members and vertical members. This Figure shows the end sealing element 26 which also has a centering cam 29 that cooperates with a cavity of the glass support profile 10. The glass support profile 13 is elastically supported on the outer surface of the end sealing element 26.

For separately draining the condensate, the end sealing element 26 can be provided with the drain 16 or, if the leakage water is added, with the drainage channel 27 and the filter insert 25.

Figure 13:
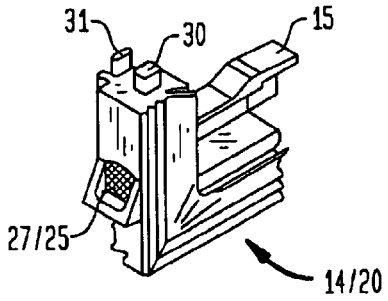
FIGS. 13, 14 different end sealing elements.

FIG. 13 shows the end sealing element 14, representative also of the end sealing element 20 which has been described in detail above. Instead of the drainage channel 27 and the illustrated sealing insert 25, the end sealing element is to be provided with the drain 16 for separate condensate drainage.

Figure 14:
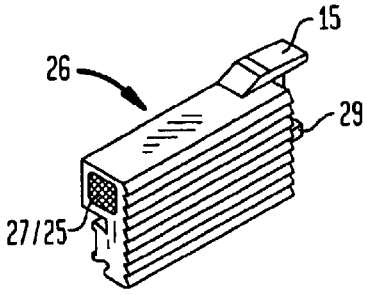

The same applies also to FIG. 14 which shows the end sealing element 26.

Instead of using corner sealing elements or end sealing elements, the sealing strip 10 including the condensate channel 11 can extend into the overlap region of cross member 2 and vertical member 1 (not shown here). The sealing strip 13 of the vertical member profile is then extended to the outside of the condensate channel 11 under pretension, wherein an adapter element is inserted in the condensate channel 11 in the region of the sealing strip 13 which compensates, on one hand, the difference in overall height to the glass support and closes the condensate channel 11, so that the condensate can be diverted through a stamped opening in the channel bottom of the condensate channel 11 to the space 9 under the sealing strip 13 or into the chamber 7.

The adapter element can also form a channel in which a filter insert 25 is the arranged which effects drainage into the joint and/or the leakage water channel 8.

Figure 18:
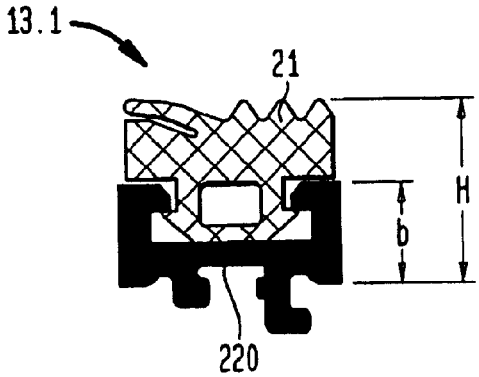

In particular in the last described embodiment, but also in the embodiments depicted in FIGS. 7, 8, 9, 10, 12 and 14, which all include the end sealing element 26, the height difference between the cross member profile and the vertical member profile to the glass support plane can also be compensated by a two-piece seal 13 on the vertical member (see FIG. 18). Contemplated is here a combination of an aluminum base strip and a corresponding sealing strip 10 without a condensate channel.

The structure of the sealing strips, and in particular the sealing strips that have an attached or integrally formed drainage channel, will now be described in detail.

Figure 15:
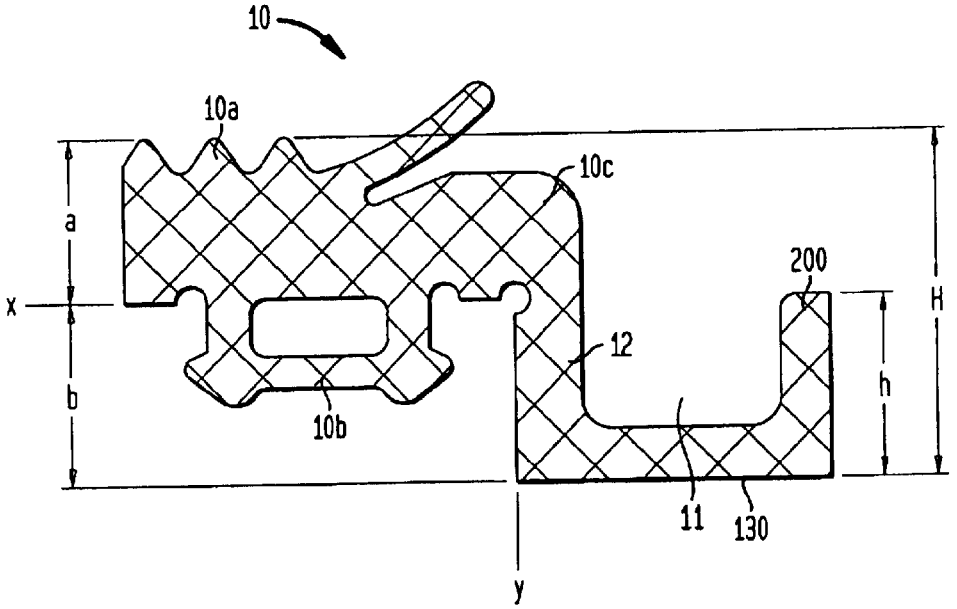
FIG. 15 an enlarged cross-sectional view of a sealing strip for the cross member profile.

FIG. 15 shows an enlarged cross-sectional view of the sealing strip 10, wherein the plane X of the sealing strip 10 is supported on the two upper edges of the sealing groove 5 and the sealing strip 10 is held by the sealing foot formfittingly in the cross member profile 2. A rib 10*c*, which is formed directly on the side of the glass support region 10*a* and has essentially the height of the glass support region 10*a*, is connected to the sealing structure. The exemplary sealing structure corresponds essentially to the conventional glass support region 10*a* with a sealing foot 10*b* integrally formed for engagement in the sealing groove 5, which (not shown here) can also be hingedly connected via a type of film hinge, so that the glass support region can be relatively easily separated from the foot region in the overlap region with the vertical member profile. The condensate channel 11 which is open to the insulating glass pane but is otherwise rectangular and has a substantially U-shape, is formed on the stable rib 10*c*, which encompasses the outer lateral edge of the sealing groove 5. The condensate channel 11 is formed by the channel walls 12, 200 and the channel bottom 130 and is supported on the cross member profile 2 with the side 12 facing the cross member profile 2. The plane Y of the channel wall 12 oriented towards the sealing structure hence forms also the lateral attachment and contact plane on the cross member profile 2.

The sealing structure and/or the glass support region 10*a* have—and seen from the plane X, i.e., the top edge of the sealing groove 5—a height "a", whereas the leakage water channel that extends from the plane X to the bottom edge of the channel bottom 130 has the dimension "b". The effective overall height "H" of the sealing strip 13 for the vertical member profile 1 is composed of the height of the glass support region and the dimension "b" of the leakage water channel, i.e., the sum "a+b".

The dimensions a and b are selected such that the channel bottom 130 of the leakage water channel is positioned on the top edges of the sealing groove 6 of the vertical member profiles. In addition, the channel wall 200 is perpendicular to the channel bottom 130 and in a particular embodiment forms a part of the contact surface for the sealing strip 13.

In an advantageous embodiment, the height h of the channel wall 200 is equal to the dimension "b" of the condensate channel 11.

Figure 16:
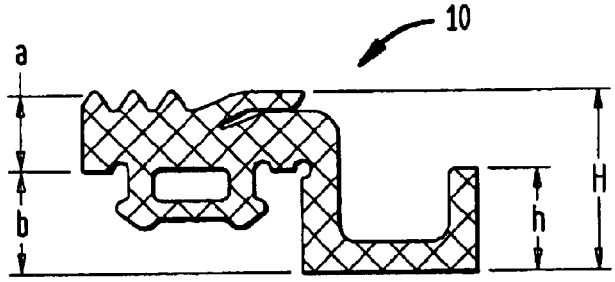
FIGS. 16–18 different cross-sections of sealing strips for cross member and vertical member profiles.
Figure 17:
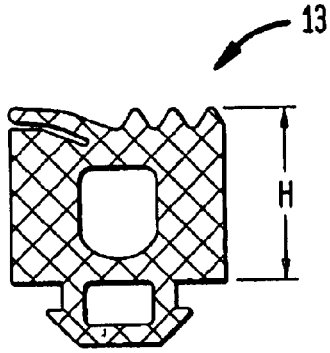

FIGS. 16 to 18 enable a comparison of the overall dimensions of the different seals. FIG. 16 shows the sealing strip 10 for the cross member profile 2, FIG. 17 shows the sealing strip 13 for the vertical member profile, and FIG. 18 shows a combined sealing unit 13.1 for the vertical member profile. FIGS. 16 to 18 are laid out next to each other to clearly indicate that the glass support profile 10 for the cross member profiles including the condensate channel 11 has the same overall height as the vertical member seals according to FIGS. 16 and 17.

Accordingly: H=a+b.

According to FIG. 18, the sealing strip or the sealing strip 13.1 are formed as two pieces, i.e., the sealing strip includes a sealing strip 21 made of a sealing material and a joint reduction profile 220 which is typically made of the same material as the cross member profile and the vertical member profile, i.e. possibly or preferably fabricated of aluminum.

The joint reduction profile 220 has a height b which in a particularly advantageous embodiment of the channel wall 200 corresponds to the height of the seal 10.

The sealing strip 21 into this configuration can extend to the channel rib or bottom of the sealing strip 10, wherein the sealing foot of the sealing strip 21 is removed in the overlap region with the condensate channel 11. The corresponding drainage channel is filled by the filter insert 25 or closed by a sealing element. This ensures that the condensate water is drained into the leakage water channel 8 or the cavity underneath the sealing strip 7, 9 of the vertical member profile.

Figure 19:
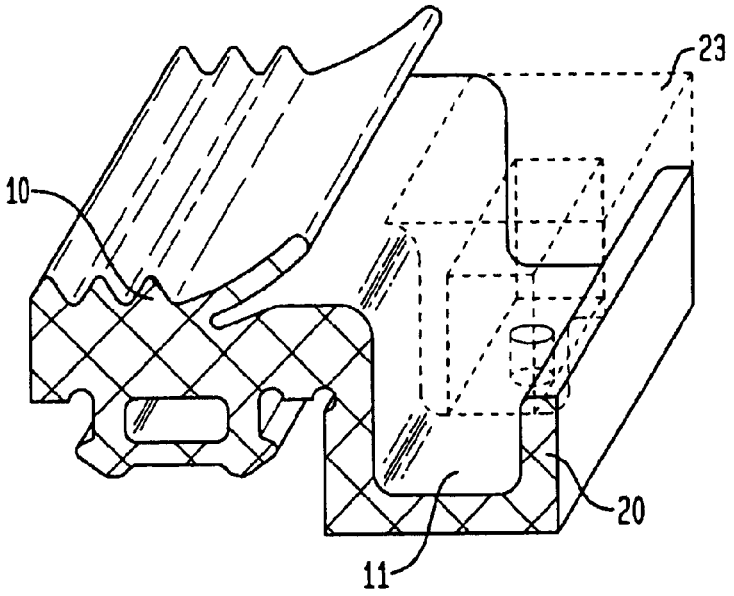
FIGS. 19, 20 perspective views of sealing strips.

FIG. 19 shows a section of the sealing strip 10, wherein a shaped sealing element 23 can be inserted into the end sections of the sealing strip 10 in the region of the condensate channel 11. This shaped sealing element 23 extends the condensate channel to the upper sealing surface of the sealing strip 10 and also terminates flush with the channel wall 20, so that the sealing strip of the vertical member profile forms a smooth contact surface for an end seal in the overlap region between the cross member profile 2 and the vertical member profile 1. In the present example, the sealing strip 10 is extended, to the overlap region of the profiles, without the need for additional corner sealing elements or end sealing elements.

The shaped sealing element 23 leaves a channel open so that a stamped opening in the bottom of the condensate water channel 11 is accessible for draining the condensate.

Figure 20:
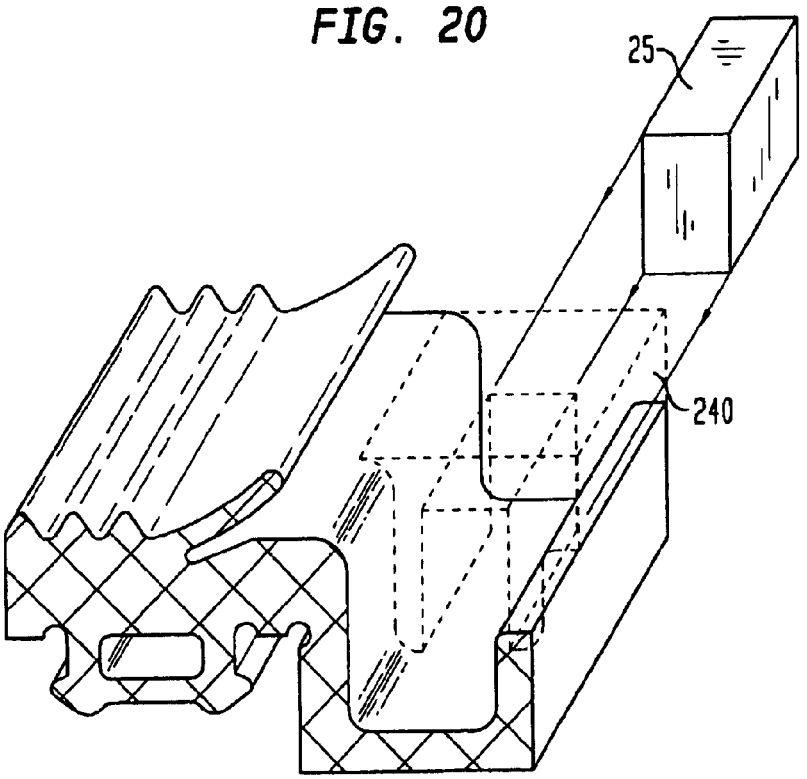

Unlike the shaped sealing element shown in FIG. 19, the shaped sealing element 240 of FIG. 20 includes a continuous channel so that the condensate can be directed into the leakage water reservoir of the cross member profile. The filter insert 25 made of a synthetic PA filter medium can be inserted into this open channel.

Figure 21:
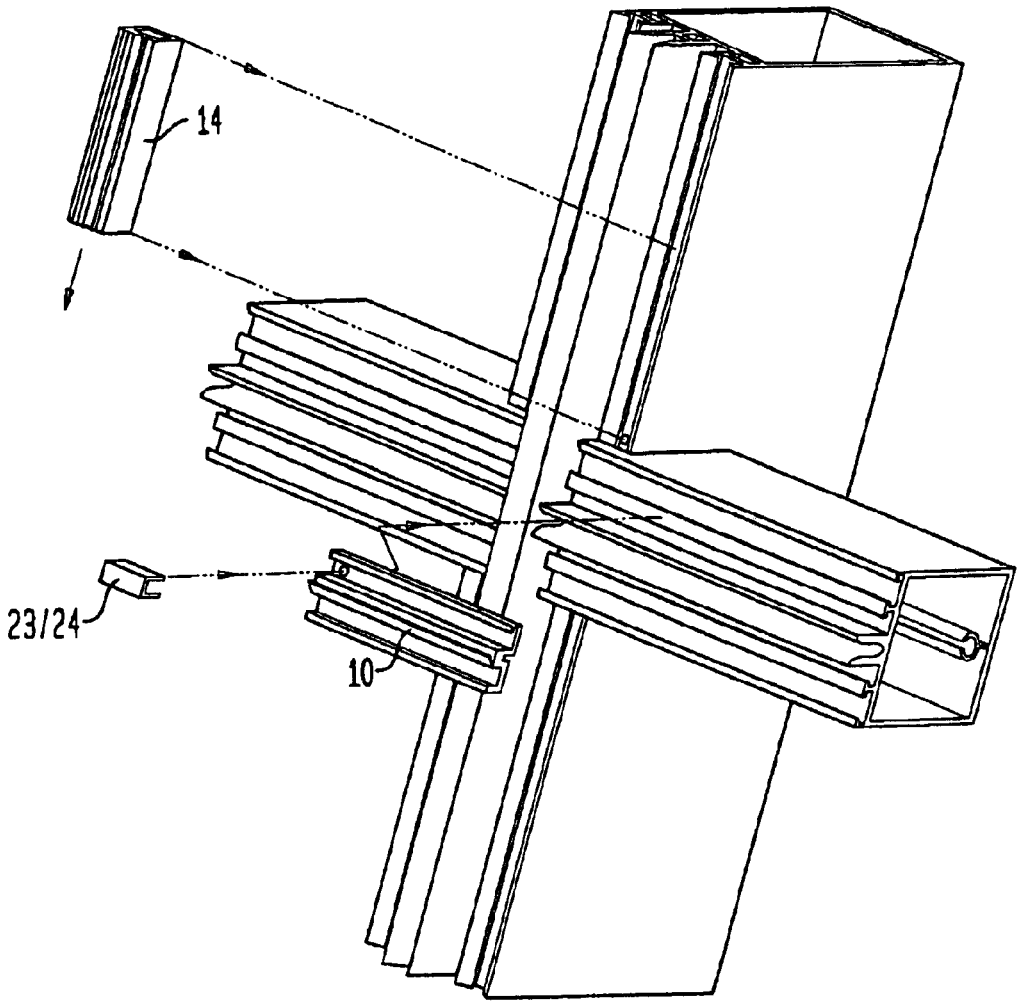
FIG. 21 a partially exploded view of crossing regions of cross member and vertical member profiles of another embodiment.

FIG. 21 shows again a facade crossing point or crossing region. The sealing strip 10 is once more extended into the overlap region, so that the condensate channel is supported on the sealing groove of the vertical member profile.

The shaped sealing element 23, 240 forms the closed support surface, so that the sealing strip 13 can sealingly contact the sealing strip 10 and/or the condensate channel 11.

What is claimed is:

1. A metal framework for a facade or roof window with frame areas adapted to receive insulating glass panes, the framework comprising a plurality of vertical member profiles having vertical receiving channels for leakage water and vertical sealing grooves; vertical sealing strips received in the vertical sealing grooves;

plurality of transverse member profiles oriented perpendicular to the vertical member profiles and having transverse sealing grooves for receiving transverse sealing strips and transverse receiving channels for leakage water, wherein the transverse sealing grooves and receiving channels each include a bottom section positioned on the vertical sealing grooves, and transverse sealing strips received in the transverse sealing grooves, wherein the vertical and transverse sealing strips are adapted to support the insulating glass panes, wherein the vertical sealing strips are formed in one or more sections and have a greater overall height than the transverse sealing strips, so that the transverse sealing strips and the vertical sealing strips terminate in a common plane, wherein one or more vertical or transverse sealing strips have at least one drainage channel which is formed as one-piece on the corresponding sealing strip, and wherein a drainage channel of the transverse sealing strip extends directly or indirectly to the glass support area of the vertical member profiles and is adapted to drain into a drainage channels of the vertical member profiles.

2. The metal framework of claim 1, wherein the vertical sealing groove is located above a cavity.

3. The metal framework of claim 2, wherein the vertical sealing groove is formed with the cavity as one-piece.

4. The metal framework of claim 1, wherein the at least one drainage channel has an angular cross-section.

5. The metal framework of claim 1, wherein the at least one drainage channel has a rectangular cross-section.

6. The metal framework of claim 1, wherein the at least one drainage channel has a U-shaped cross-section.

7. The metal framework of claim 1, wherein the at least one drainage channel has a round or prismatic cross-section.

8. The metal framework of claim 1, wherein a wall of the at least one drainage channel facing the glass support region sealingly contacts an outer surface of the transverse member profile or vertical member profile.

9. The metal framework of claim 1, wherein the bottom of the at least one drainage channel of the transverse member profile is flush with a bottom side of a wall of the transverse member profile.

10. The metal framework of claim 1, and further comprising a corner sealing element connected with the vertical sealing strip, wherein the transverse sealing strip extends into the region of the vertical sealing strip and makes contact with the corner sealing element.

11. The metal framework of claim 10, wherein the corner sealing element has an extension matching the drainage channel of the transverse member profile, said extension surrounding the drainage channel laterally and/or from below.

12. The metal framework of claim 10, wherein the corner sealing element comprises a drainage channel facing the transverse member profile, said drainage channel terminating in a hollow channel in a region that is flush with the vertical sealing strip, with a drain extending through the bottom section of the sealing groove and terminating in the cavity or in the sealing groove which is open towards the bottom section.

13. The metal framework of claim 1, and further including a corner sealing element, wherein the drainage channel of the vertical sealing strip is encompassed by an extension of the corner sealing element.

14. The metal framework of claim 13, wherein the corner sealing element has a base section which engages with both the vertical and the transverse sealing grooves.

15. The metal framework of claim 1, wherein the drainage channel is connected with the vertical receiving channel to form a connected channel, and further including a filter insert inserted in the connected channel.

16. The metal framework of claim 13, wherein the corner sealing element has a channel which is aligned with the drainage channel and forms an extension of the drainage channel, said channel of the corner sealing element penetrating a leg of the corner sealing element which is flush with the vertical sealing strip.

17. The metal framework of claim 13, wherein the corner sealing element has a drainage extension to the vertical receiving channel.

18. The metal framework of claim 1, wherein the drainage channel of the transverse sealing strip abuts a seal termination, which extends the transverse sealing strip to the region of the vertical member profile.

19. The metal framework of claim 18, wherein a base of the seal termination engages with the transverse sealing groove.

20. The metal framework of claim 18, wherein a width of the seal termination corresponds to a total width of the transverse sealing strip and the drainage channel, so that an end face of the transverse sealing strip is sealingly urged against an end face of the seal termination.

21. The metal framework of claim 18, wherein the seal termination includes a drainage channel.

22. The metal framework of claim 21, wherein the drainage channel of the seal termination runs into the drainage channel of the vertical member profiles.

23. The metal framework of claim 18, wherein the seal termination is cut according to a splicing angle between the transverse member profile and the vertical member profile.

24. The metal framework of claim 18, wherein the seal termination includes a centering pin that cooperates with a cavity of the transverse sealing strip.

25. The metal framework of claim 1, wherein the transverse sealing strip and the drainage channel extend to a region where the transverse member profiles and the vertical member profiles overlap.

26. The metal framework of claim 1, wherein the vertical sealing strip is guided to the outside of the drainage channel under a pretension, and further comprising an adapter which is inserted in the drainage channel in the region of the vertical sealing strip, with the adapter compensating differences in the overall height of the vertical and transverse sealing strips and closing the drainage channel.

27. The metal framework of claim 1, wherein the vertical sealing strips are composed of several sections.

28. A sealing strip for a support structure for a facade or a roof, said support structure comprising transverse member profiles and vertical member profiles, wherein the sealing strip is disposed on at least one of the transverse member profiles and vertical member profiles and has a support region for a glass pane, the sealing strip comprising a drainage channel with a substantially rectangular U-shaped cross-section and being integrally formed on and connected with the glass support region through a rib, wherein the transverse member profile comprises a sealing groove, wherein the sealing strip of the transverse member profile has a base and two upper edges, wherein the base is formfittingly held in the transverse member profile and a section of the sealing strip located in a plane contacts the two upper edges of the sealing groove, wherein the rib overlaps with an outer lateral edge of the sealing groove, with the drainage channel being integrally formed at the outer lateral edge of the sealing groove.

29. The sealing strip of claim 28, wherein the drainage channel includes mutually parallel channel walls and a channel bottom oriented perpendicular to the channel walls.

30. The sealing strip of claim 28, wherein the sealing strip extends to the channel bottom, and wherein the base of the sealing strip is removed in a region where the base of the sealing strip overlaps with wherein the sealing strip extends to the channel bottom in the absence of the base in a region which overlaps the drainage channel.

31. The sealing strip of claim 29, further comprising a molded sealing element that is inserted in the sealing strip in the region of the drainage channel, said molded sealing element extending the drainage channel to the upper sealing surface of the sealing strip and terminating flush with an outer channel wall.

32. The sealing strip of claim 31, wherein the molded sealing element leaves a channel unobstructed, so that a stamped hole disposed in the bottom of the drainage channel is accessible for draining a condensate.

33. The sealing strip of claim 31, wherein the molded sealing element has a continuous channel, so that a condensate can be directed to a drainage channel of the transverse member profile, and further comprising a filter insert made of a synthetic PA filter material and adapted for insertion in the drainage channel.

34. The sealing strip of claim 31, wherein the molded sealing element forms a closed support surface, so that the sealing strip sealingly contacts the drainage channel.

35. The sealing strip of claim 29, wherein the vertical member profile comprises a sealing groove, with the channel bottom of the drainage channel being supported on an upper edge of the sealing groove of the vertical member profile.

36. The sealing strip of claim 28, wherein the channel walls have a height that corresponds to a spacing between a channel bottom of the drainage channel and the plane that contacts the two upper edges of the sealing groove.

37. The sealing strip of claim 28, wherein at least one sealing strip for the transverse member profile or vertical member profile is formed of multiple sections.

38. A sealing strip for a support structure for a facade or a roof, said support structure comprising transverse member profiles and vertical member profiles, wherein the sealing strip is disposed on at least one of the transverse member profiles and vertical member profiles and has a support region for a glass pane, the sealing strip comprising a drainage channel with a substantially rectangular U-shaped cross-section and being integrally formed on and connected with the glass support region through a rib, wherein the sealing strip extends to a region where the transverse member profile and vertical member profile overlap, and wherein the drainage channel contacts the sealing groove of the vertical member profile.

* * * * *